United States Patent [19]

Fischer et al.

[11] Patent Number: 4,491,722

[45] Date of Patent: Jan. 1, 1985

[54] MOUNTING ARRANGEMENT FOR AN ELECTRIC HOTPLATE WITH A SUPPORT RING SURROUNDING IT

[75] Inventors: Karl Fischer, Karl-Fischer-Strasse 23, D-7519 Oberderdingen, Fed. Rep. of Germany; Felix Schreder, Oberderdingen, Fed. Rep. of Germany

[73] Assignee: Karl Fischer, Fed. Rep. of Germany

[21] Appl. No.: 521,648

[22] Filed: Aug. 9, 1983

[30] Foreign Application Priority Data

Aug. 13, 1982 [DE] Fed. Rep. of Germany ..... 3230085
May 14, 1983 [DE] Fed. Rep. of Germany ..... 3317624

[51] Int. Cl.[3] ..... H05B 3/68

[52] U.S. Cl. ..... 219/458; 219/457; 219/463; 219/464

[58] Field of Search ..... 219/445, 447, 449, 457, 219/458, 459, 460, 461, 462, 463, 464, 465, 466, 467, 468

[56] References Cited

U.S. PATENT DOCUMENTS

| | | | |
|---|---|---|---|
| D. 184,606 | 3/1959 | Cramer et al. | D15/113 |
| D. 190,066 | 4/1961 | Kamin | D7/121 |
| D. 249,863 | 10/1978 | Fischer | D7/121 |
| 2,664,492 | 12/1953 | Fischer | 219/457 X |
| 3,194,945 | 7/1965 | Barnett | 126/214 A |
| 3,300,621 | 1/1967 | Fischer | 219/458 |
| 3,739,149 | 6/1973 | Fischer et al. | 219/464 X |
| 3,838,249 | 9/1974 | Detterbeck | 219/460 |
| 4,122,330 | 10/1978 | Fischer et al. | 219/449 |
| 4,410,793 | 10/1983 | Fischer et al. | 219/460 |

FOREIGN PATENT DOCUMENTS

| | | | |
|---|---|---|---|
| 82791 | 4/1957 | Denmark | 219/457 |
| 99599 | 8/1964 | Denmark | 219/457 |
| 61036 | 9/1982 | European Pat. Off. . | |
| 1250025 | 9/1947 | Fed. Rep. of Germany . | |
| 904672 | 7/1949 | Fed. Rep. of Germany | 219/457 |
| 872835 | 2/1953 | Fed. Rep. of Germany . | |
| 1726413 | 6/1956 | Fed. Rep. of Germany . | |
| 1004786 | 3/1957 | Fed. Rep. of Germany | 219/457 |
| 1021967 | 6/1958 | Fed. Rep. of Germany | 219/457 |
| 1774264 | 9/1958 | Fed. Rep. of Germany . | |
| 1786955 | 4/1959 | Fed. Rep. of Germany . | |
| 1852939 | 9/1961 | Fed. Rep. of Germany . | |
| 1849432 | 4/1962 | Fed. Rep. of Germany . | |
| 1130574 | 5/1962 | Fed. Rep. of Germany | 219/457 |
| 1127007 | 10/1962 | Fed. Rep. of Germany . | |
| 1165175 | 9/1964 | Fed. Rep. of Germany . | |
| 1291032 | 3/1969 | Fed. Rep. of Germany . | |
| 1188744 | 7/1969 | Fed. Rep. of Germany . | |
| 1288704 | 9/1969 | Fed. Rep. of Germany . | |
| 1565512 | 2/1970 | Fed. Rep. of Germany . | |
| 6604803 | 2/1970 | Fed. Rep. of Germany . | |
| 1554732 | 4/1970 | Fed. Rep. of Germany . | |
| 1565528 | 4/1970 | Fed. Rep. of Germany . | |
| 1565529 | 4/1970 | Fed. Rep. of Germany . | |
| 1811900 | 7/1970 | Fed. Rep. of Germany . | |
| 2126614 | 12/1972 | Fed. Rep. of Germany . | |
| 2620004 | 1/1978 | Fed. Rep. of Germany . | |
| 2735426 | 2/1979 | Fed. Rep. of Germany . | |
| 7914111 | 8/1979 | Fed. Rep. of Germany . | |
| 7914082 | 8/1979 | Fed. Rep. of Germany . | |
| 2909776 | 9/1980 | Fed. Rep. of Germany | 219/467 |
| 1531091 | 5/1968 | France | 219/463 |
| 29232 | 3/1961 | German Democratic Rep. | 219/457 |
| 605897 | 6/1960 | Italy | 219/457 |
| 81889 | 8/1952 | Norway | 219/457 |
| 84398 | 8/1954 | Norway | 219/457 |
| 158713 | 9/1953 | Sweden | 219/457 |
| 305675 | 5/1955 | Switzerland | 219/457 |

OTHER PUBLICATIONS

Preliste 5220, E.G.O. Elektro-Gerate, Blanc u. Fischer 1/7/74.

Jackson Perspectus, Jackson Industries, Ltd., "Speed Ring Plates—New Developments".

*Primary Examiner*—Volodymyr Y. Mayewsky

*Attorney, Agent, or Firm*—Steele, Gould & Fried

[57] ABSTRACT

A conventional electric hotplate with a sheet metal supporting ring surrounding the same is fitted into a glass or ceramic built-in plate, while using an intermediate ring, whose outer rim rests on the built-in plate, while the support ring is supported thereon. The intermediate ring has a flat S-shaped configuration and is much wider than it is high. Thus, the built-in opening can be made larger than the hotplate. A packing, which is held and shielded by an insert ring, surrounds the inner rim of the built-in opening. The packing is located on a substructure, which has centering projections for the insert ring or the hotplate.

27 Claims, 5 Drawing Figures

FIG. 3
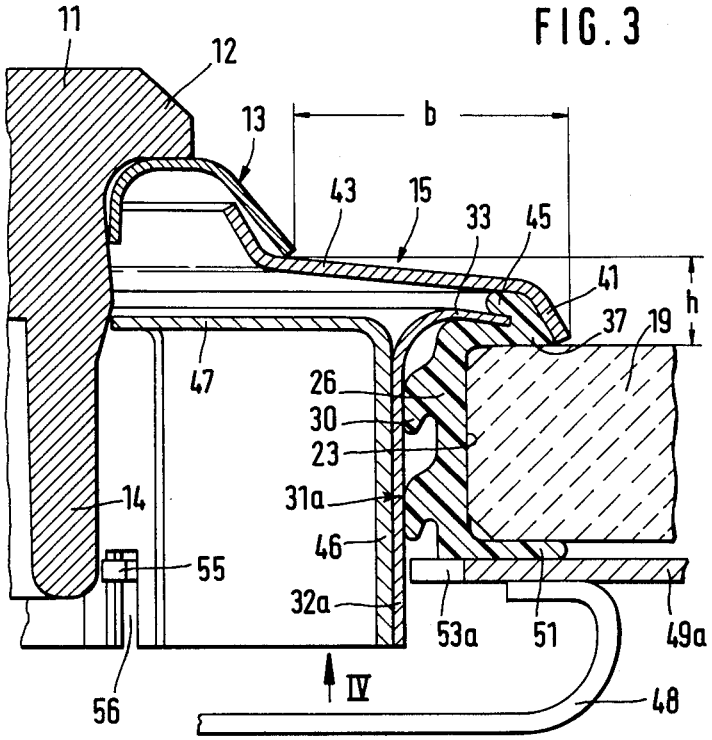
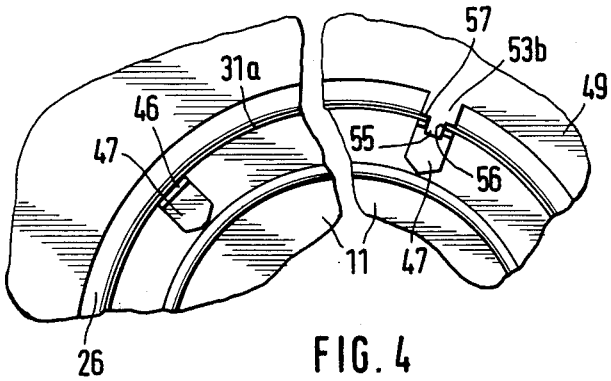
FIG. 4

MOUNTING ARRANGEMENT FOR AN ELECTRIC HOTPLATE WITH A SUPPORT RING SURROUNDING IT

BACKGROUND OF THE INVENTION

The invention relates to a mounting arrangement for an electric hotplate with a sheet metal support ring surrounding it for fitting into an opening of a glass or ceramic mounting plate with an intermediate ring, on which the support ring is supported, whose outer edge is supported on the mounting plate (in the following referred to as built-in plate).

Ceramic or glass built-in plates are already known, which are rigid and unsensitive, while having an easily cleaned surface. The thermal shock sensitivity of these plates makes it necessary to take special measures to protect the built-in plates against the heat of the hotplates.

DOS No. 21 26 614, which corresponds closely to U.S. Pat. No. 3,838,249, discloses a built-in arrangement, in which a very high intermediate ring is used and which is made from solid materials or in double-walled manner in such a way that its flat bottom, which is set back somewhat with respect to the outer edge, can receive a seal or packing, which rests on the built-in plate. This intermediate ring has a complicated construction and requires a very accurate matching of the packing with respect to the contact pressure, so that on the one hand the fitting is tight and on the other the outer edge engages roughly on the built-in plate, so as to ensure that there is no disturbing gap. The built-in plate is shielded from the heat of the electric hotplate in that the latter is fitted completely above the built-in plate. Such an arrangement is however, visually unattractive and functionally disadvantageous, because it is not possible to draw the cooking utensil from the built-in plate or to the hotplate. In addition, the built-in plate material extends up to close to the hotplate circumference, because this is made necessary by the packing located centrally below the intermediate ring.

German Utility Model No. 79 14 082 already discloses the flat, wide support ring, which is supported with a packing in the outer area of the ceramic built-in plate. Although this ring makes it possible to keep the edge area of the built-in plate at a lower temperature level, it requires a special construction with respect to the hotplate support ring and due to its wide, flat shape must be made from a relatively strong material, so that it does not resiliently give way when subject to higher loads. Moreover, due to the relatively large temperature gradient between its inner and outer periphery, there is a differing discoloration of the ring due to temper colors, which is also visually unattractive.

SUMMARY OF THE INVENTION

The object of the invention is to provide a built-in arrangement, which permits a problem-free fitting of standard electric hotplates, requiring no special adaptation, in temperature-sensitive, and more particularly, glass or ceramic built-in plates.

This object is achieved in that the width of the intermediate ring is much greater than its height between the seating of the outer rim of the support ring thereon and its seating on the mounting plate, and the opening has a much larger diameter than the external diameter of the hotplate, including the support ring, the intermediate ring covering the distance between the opening edge and the external diameter of the hotplate.

Through the use of an intermediate ring, it is possible to use standard hotplates with a relatively narrow support ring (also called an overflow edge). As it rests by the outer rim of the built-in plate and as its seal or packing may also be located there, the opening in the built-in plate can be made much larger than the overall diameter of the hotplate. Thus, the opening edge of the built-in plate has a considerable distance from the outer circumference of the electric hotplate and this alone keeps it at a lower temperature level. The choice of a flat intermediate ring permits a relatively flat hotplate fitting with all the resulting esthetic and use advantages. The problem of differing temper colors is also partly solved, even if the materials of the support ring and intermediate ring are the same, because there is a greater temperature jump at the abutting edge between support ring and intermediate ring, so that the temper colors are largely limited to the support ring and there is a clear optical separation, which tends to be more readily accepted. However, preferably, the intermediate ring is made from a different material from the support ring, so that in any case an optical separation occurs and it is optically considered that the intermediate ring is either a separate part, or possibly a portion belonging to the built-in plate. If the intermediate ring is made from a thicker sheet material than the support ring, a comparable rigidity of the two rings is obtained, because the support ring is on the one hand narrower and on the other more strongly profiled, while the intermediate ring is wider and flatter.

Advantageously, in connection with the built-in arrangement, an insert ring is provided, which is completely covered by the intermediate ring, has a substantially annular shielding section covering the opening rim of the opening and means for positioning a packing in such a position that the sealing area acting between the built-in plate and the intermediate ring is positioned close to the outer circumference of the latter. This separate insert ring shields the parts of the built-in plate facing the hotplate, namely the inner opening rim and its upper edge. It simultaneously positions the packing in such a way that it cooperates with the outer rim of the intermediate ring. There is minimum thermal stressing to the packing at this point and it is possible to make the opening as large as possible.

The insert ring has a generally L-shaped cross-section with an outwardly projecting upper flange.

The packing can be a sealing ring with a substantially U-shaped cross-section spanning the fitting opening and on whose upper leg is provided the sealing area. The seal preferably has inwardly directed ribs, which center the insert ring. This packing ring forms an additional mechanical and thermal shield for the sensitive opening rim and is also thermally shielded and centered by the insert ring and is also protected against flying off the opening rim. The centering ribs lead to the formation of a minimum contact area between insert ring and packing, as well as an insulating air gap therebetween. The means for positioning the packing can consequently be formed by the outer circumference of the cylindrical part of the insert ring, or also by the end area of the flange, around which can be placed a sealing lip. Preferably the width of the intermediate ring can be two to four times greater than its height between the seating of the outer edge of the support ring thereon and its seating on the built-in plate.

The intermediate ring can have an inwardly upwardly sloping inner rim covered by the support ring and which in conjunction with the support ring forms a centering edge. On this inner edge, which preferably projects well up into the support ring, the hotplate is centered on the intermediate ring or, if the hotplate is centered by its own fastening, the intermediate ring in its position relative to the built-in plate. The intermediate ring preferably has a flat S-shaped cross-section with three outwardly sloping portions, there being a very flat central portion between the inner edge and an also steep outer edge. The inner edge and outer edge can preferably be steeper than 45° (preferably 50°), while the central portion only has a gradient between 3° and 10°. The intermediate ring can be a single, horizontal, cross-sectionally flat-profiled sheet metal ring. Thus, it need not be double-walled or made from solid material, which not only offers manufacturing advantages, but also improves it in its function. If, on its inside, the insert ring advantageously has means for centering the hotplate, it has a triple function, namely the exact positioning of the packing and intermediate ring towards the outside, the thermal shielding of the edge of the glass plate and also the exact positioning or centering of the electric hotplate towards the inside. The invention makes it possible to place hotplates having different external diameters in built-in plates having a given hole size. For this purpose it is provided according to the invention that insert rings with varyingly long, inwardly directed flap parts are provided for adapting hotplates having different diameters for a specific hole diameter in the built-in plate. In addition, the insert ring for the indirect centering of the hotplate can be provided in a substructure for the built-in plate, in that centering projections of the substructure are supported on the insert plate.

BRIEF DESCRIPTION OF THE DRAWINGS

Further advantages and features of the preferred embodiments can be gathered from the description and drawings. Two embodiments are described hereinafter relative to the drawings, wherein:

FIGS. 1 and 3 are each partial cross-sections through the built-in arrangement, i.e. the connecting area between the hotplate body and the built-in plate.

FIGS. 2 and 4 are reduced scale partial views in the direction of arrows II and IV respectively.

DETAILED DESCRIPTION OF THE PREFERRED EMBODIMENTS

Figure 1:
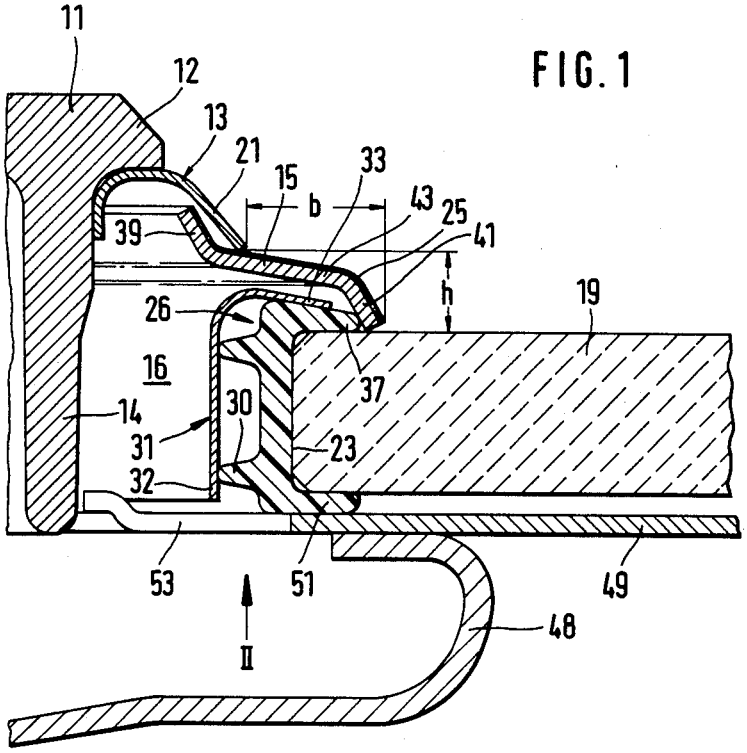
Figure 2:
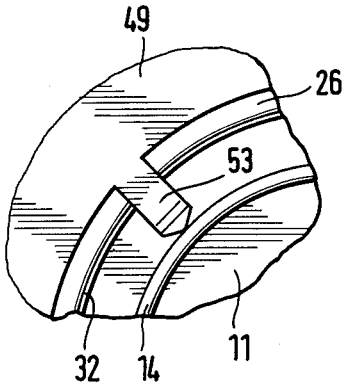

FIGS. 1 and 2 show an electric hotplate 11, whose hotplate body is made from cast material, which has an upper, planar, closed cooking surface and is electrically heated by heating resistors (not shown) inserted in slots on its bottom.

On the upper outer circumference of the hotplate is provided a projecting flange 12, against which is supported from below a sheet metal support ring 13, which has an inverted, irregular U-shaped cross-section, whose outer leg extends outwards and downwards at an angle of approximately 45°. The outer rim 21 of the support ring rests on an intermediate ring 15, which has a flat S-shaped cross-section. On to its central portion 43, which slopes away under a very shallow angle, for example, 3°–10°, are inwardly and outwardly connected inner and outer edges 39, 41, which have a gradient of more than 45° (preferably 60°). The outer edge 21 of the very wide support ring 13 rests on the central portion 43 in the vicinity of the bend between inner edge 39 and said central portion. Between this seating position and the outer edge of the outer rim, the intermediate ring 15 has a height h, which is approximately half to a quarter of the width b measured between the same points. The inner rim 39 projects into the support ring and forms a centering edge.

While support ring 13 is normally made from relatively thin stainless steel with a thickness of approximately 0.4 mm, the intermediate ring is made from a thicker metal sheet with a thickness of approximately 0.8 mm, which has a surface coating 25, e.g. an enamel coating on its outside. Thus, there is a color difference between the intermediate ring and the support ring and it can be more easily cleaned than a stainless steel ring. The internal diameter of opening 16 is much larger than the external diameter of the hotplate, including the support ring 13.

The outer rim 41 of intermediate ring 15 rests on a built-in plate 19, which is made from a relatively shock resistant glass or ceramic material. The flat built-in plate is provided with a plurality of cut-out openings 16 for a plurality of hotplates and is itself fitted into an opening of the workplate of a piece of kitchen furniture or a cooker. The rim 23 of opening 16 of built-in plate 19 is surrounded by a seal or packing 26, which has a U-shaped cross-section, with outwardly directed legs 37 and 51 covering the upper and lower rim or edge areas respectively. On its inside, the heat resistant plastic packing has annular, all-round ribs 30.

An insert ring 31 has a substantially L-shaped configuration with a cylindrical shielding portion 32 and an outer flange 33, which is slightly downwardly chamfered in accordance with the configuration of the packing ring. Flange 33 ends somewhat before the end of leg 37 of the packing, so that the outer end of the leg 37 of packing or seal 26 engages on the inside of the outer edge 41 of the intermediate ring and seals the same.

Insert ring 31 shields the packing against direct thermal radiation, as well as from the hotplate and also from the inner area of the support ring and the intermediate ring, so that only the outer area of the packing is in contact with the connection to the hotplate formed by the support ring and the intermediate ring. Intermediate air spaces are formed between ribs 30 and shielding portion 32, which constitute an additional insulation. Below the built-in plate 19 is provided a trough or plate-like substructure 49, on which rests the built-in plate, leg 31 of the sealing flange engaging below the opening rim 23. In the vicinity of the built-in opening 16, the substructure also has an opening, but is underlaid there by a trough or U-shaped part 48, on which the plate can be braced by means of a conventional central bolt or pin (not shown). Thus, the tension applies no bending stress to the built-in plate 19. On the inner circumference of the opening of substructure 49 there are several, e.g. six centering projections 53, which are in the form of inwardly directed flaps, which can be somewhat offset and preferably have a truncated, inwardly directed tip (FIG. 2), which minimizes heat conduction. They cooperate with the hotplate rim 14 in order to directly center the same on the substructure. The shielding portion 32 extends down to substructure 49 and shields packing 26 and built-in plate 19 against radiation.

FIGS. 3 and 4 show an arrangement similar to that of FIGS. 1 and 2, except for the differences described hereinafter. The same or comparable parts carry the same reference numerals and will not be described again. While having substantially the same height h, intermediate ring 15 has a greater width b, but otherwise it is the same as described hereinbefore. While having the same basic form, packing 26 has a different configuration and dimensioning of ribs 30, which press in sealing lip-like manner against insert ring 31. The upper leg 37 of packing 26 has an outer, C-shaped inwardly tilted back sealing lip 45, which engages round the outer edge of flange 33 of insert ring 31 and consequently forms a large-area engagement between outer rim 41 of the intermediate ring and the packing, which extends up to the bend to central portion 43. Although the packing is not completely sealed here against the electric hotplate, this is acceptable due to the greater width of the intermediate ring. In this embodiment, the difference between the diameter of opening 16 and the external diameter of the electric hotplate is still larger than in the embodiment according to FIG. 1 and is in fact more than double the support ring width which is visible from the outside. However, in all constructions the intermediate ring is advantageously much wider than the support ring particularly on considering the areas of the support ring and/or intermediate ring visible from the outside. The outer faces or edges of flange 12, support ring 13, intermediate ring 15 and built-in plate 19 are located on a gradually rising curve, whose maximum gradient is under 50°.

Shielding portion 32*a* extends to below the lower edge of packing 26 and the plane of substructure 49, whose centering projections 53*a* cooperate with insert ring 31*a*. A plurality of cross-sectionally L-shaped sheet metal parts 46 are welded to the periphery of its inside and these engage with a leg of the shielding portion 32*a* of insert ring 31*a*, while the other, inwardly projecting leg forms a flap 47 with a rounded or pointed end. It extends almost up to the hotplate rim 14. Thus, there is a precise centering of hotplate 11 with respect to the insert ring and consequently indirectly with respect to the built-in plate 19, as well as substructure 49 via centering projection 53*a*.

FIG. 4, in a view from below, shows one of the centering projections 53*a*, which cooperates with the outer face of insert ring 31*a*. It is also shown that at least one of the centering projections is constructed as a step-like projection 53*b*, whose central part 55 engages in a recess 56 of shielding portion 32*a* and prevents the turning of the insert ring, while the set-back lateral part 57 cooperates with the outer face of the shielding portion for centering purposes.

Figure 5:
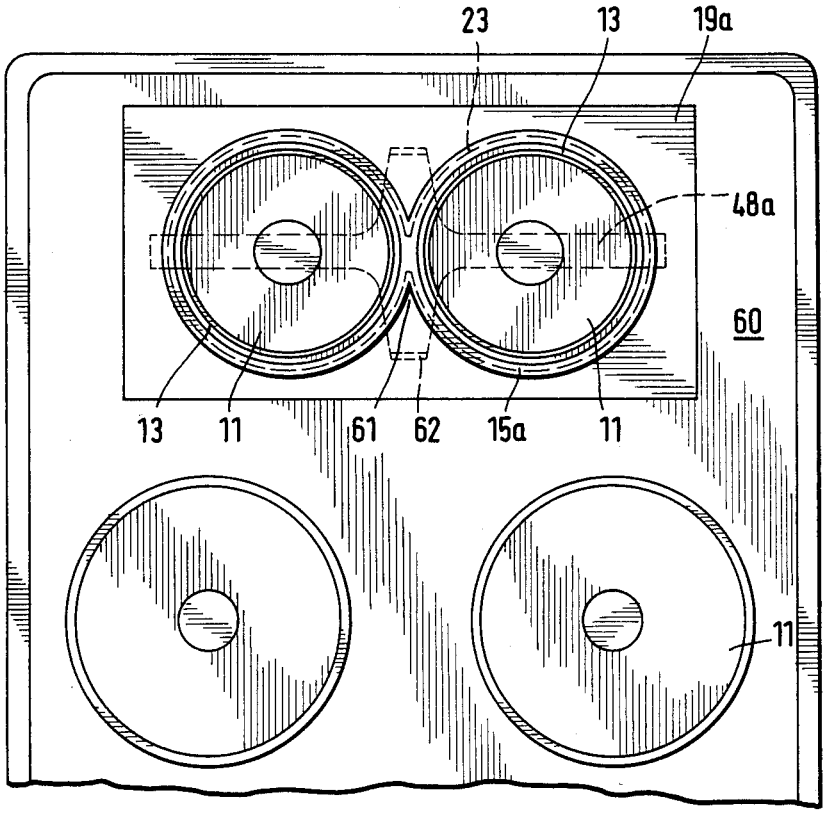
FIG. 5 is a plan view of a cooking utensil.

The embodiment of FIG. 5 shows in plan view a cooker with conventional, spaced hotplates 11, which are incorporated, for example, into a sheet metal cooker plate 60. An elongated, rectangular area of plate 60 is lowered in trough-like manner and in this area is installed a hardened glass built-in plate 19*a*, which is substantially flush with the surface of plate 60. Plate 19*a* has two circular openings, whose rim 23 is shown in broken line form and which are arranged in the longitudinal direction of the built-in plate, while overlapping somewhat in the center thereof, so that they are interconnected. Into these openings is fitted two conventional hotplates 11, whose support rings 13 are supported on a double ring 15*a*, whose cross-sectional shape and other characteristics can correspond to the rings 15 of FIGS. 1 and 2, but comprises two rings, which are joined in the center. Like the opening, double ring 15*a* has a figure-eight or spectacle-like configuration. It can be formed from two rings having a different size and into which can be inserted two hotplates of different size. It is also possible to have a different configuration of the connecting area, e.g. by rounding the inwardly directed recesses 61.

In place of the U-shaped member 48 in the hitherto described embodiments, a through carrying member 48*a* is provided, which extends from one narrow side of built-in plate 19*a* to the other and is provided with supports 62 in the lateral central area (close to indentation 61). Thus, member 48*a* ensures that the built-in plate 19*a* is protected from heavy loads or deformations.

The two hotplates 11 are positioned very close together, whereas hitherto the minimum spacing has conventionally been 5 cm. Both the hotplates have in each case a single, but optionally constructionally combined switch and can be individually switched on and off. Thus, they can be used either as individual hotplates, or as a combined hotplate. However, it is necessary for their upper cooking surfaces to be precisely aligned, which was not possible with conventional sheet metal constructions as a result of the deformations caused by heating and loading. The glass built-in plate 19*a* ensures that this flatness is maintained, particularly if member 48 is used. The double intermediate ring 15*a* also ensures rigidity and permits a good alignment of the hotplates with respect to one another. It also ensures compensation for thermal expansions, which can assume considerable values over the size of the two hotplates.

Built-in plate 19*a* can either be inserted in cooker plates, or independently in workplates. Particular preference is given to a cooker with four normal hotplates and a double cooking unit according to FIG. 5.

What is claimed is:

1. An arrangement for mounting electric hotplates in glass and ceramic mounting plates having mounting openings therein, each hotplate being fitted with a sheet metal support ring there around, the support ring having an outer rim adapted to seat on an intermediate ring, the intermediate ring having an outer edge adapted to seat on the mounting plate, the mounting plate itself being adapted to fit into openings in work-tops and cooking appliances, the arrangement comprising: the opening having a much larger diameter than the external diameter of the hotplate and the support ring fixed thereto; and, the intermediate ring having a much greater width than height between the seating of the outer rim of the support ring thereon and its seating on the mounting plates and spanning the distance between the edge of the opening in the mounting plate and the external diameter of the hotplate.

2. A mounting arrangement according to claim 1, wherein the intermediate ring is made from a different material than that of the support ring.

3. A mounting arrangement according to claims 1 or 2, wherein at least one of the surface color and structure of the intermediate ring is different than that of the support ring.

4. A mounting arrangement according to claim 3, wherein the intermediate ring has a surface coating.

5. A mounting arrangement according to claim 4 wherein the intermediate ring has an enamel coating.

6. A mounting arrangement according to claim 1, wherein the intermediate ring is made from thicker sheet metal material than the support ring.

7. A mounting arrangement according to claim 1, further comprising: a seal; and, an insert ring disposed in the opening of the mounting plate, completely covered by the intermediate ring and having a substantially annular shielding portion covering the edge of the opening in the mounting plate and means for positioning the seal to form a sealing area between the mounting plate and the intermediate ring, close to the outer circumference of the intermediate ring.

8. A mounting arrangement according to claim 7, wherein the insert ring has a generally L-shaped cross-section with an outwardly projecting flange.

9. A mounting arrangement according to claims 7 or 8, wherein the seal is a sealing ring with a substantially U-shaped cross-section, having a base which spans the opening in the mounting plate, an upper leg forming the sealing area and inwardly directed ribs, which center the insert ring and together therewith form annular insulating air pockets between the hotplate and the mounting plate.

10. A mounting arrangement according to claim 1, wherein the width of the intermediate ring is two four times larger than its height, measured in each instance between the seating of the outer rim of the support ring on the intermediate ring and the seating of the intermediate ring on the mounting plate.

11. A mounting arrangement according to claim 1, wherein the intermediate ring is a horizontal sheet metal ring with a flat-profiled cross-section.

12. A mounting arrangement according to claim 1, wherein the intermediate ring has an inwardly and upwardly directed inner rim, covered by the support ring and which together with the support ring forms a centering edge.

13. A mounting arrangement according to claim 12, wherein the intermediate ring has a flat S-shaped cross-section with three outwardly, sloping away portions, there being a very flat central portion between steep inner edge and steep outer edge portions.

14. A mounting arrangement according to claim 7, wherein the insert ring comprises means on its inner side for positioning and centering the hotplate.

15. A mounting arrangement according to claim 14, wherein the insert ring is so constructed as to simultaneously position and center the hotplate and the intermediate ring.

16. A mounting arrangement according to claims 14 or 15, wherein the insert ring comprises inwardly directed flaps or lugs.

17. A mounting arrangement according to claim 16, wherein the flaps are sheet metal parts approximately L-shaped in cross-section and spot welded in place.

18. A mounting arrangement according to claim 16, wherein the flaps are constructed for punctiform engagement on an outer rim of the hotplate.

19. A mounting arrangement according to claim 16, comprising at least three flaps.

20. A mounting arrangement according to claim 7, wherein the insert ring comprises positioning means adapted for use with holes in the mounting plate of predetermined diameter.

21. A mounting arrangement according to claim 1, further comprising a substructure positioned below the mounting plate and having centering projections which cooperate with an outer rim of the hotplate.

22. A mounting arrangement according to claim 1, wherein at least one centering projection engages in a recess of the insert ring to prevent relative rotation.

23. A mounting arrangement according to claim 1, wherein the intermediate ring is formed from two ring portions joined to one another in a figure-eight configuration adapted to receive two hotplates spaced closely to one another.

24. A mounting arrangement according to claim 23, wherein the mounting plate is a glass plate with an opening of figure-eight configuration, reinforced by an adjustable U-shaped stiffening member.

25. A mounting arrangement according to claim 13, wherein the central portion lies at an angle in a range of 3° to 10° relative to horizontal and the steep inner and outer edge portions lie at angles greater than 45° relative to horizontal.

26. A mounting arrangement according to claim 7, further comprising a substructure positioned below the mounting plate and having centering projections which cooperate with the insert ring.

27. A mounting arrangement according to claim 16, comprising four flaps.

* * * * *